United States Patent [19]

Ericsson

[11] 4,441,292

[45] Apr. 10, 1984

[54] FLOOR

[75] Inventor: Axel B. R. Ericsson, Holmsund, Sweden

[73] Assignee: Profoment Utvecklings AB, Sweden

[21] Appl. No.: 198,004

[22] PCT Filed: Feb. 27, 1980

[86] PCT No.: PCT/SE80/00053

§ 371 Date: Oct. 21, 1980

§ 102(e) Date: Oct. 21, 1980

[87] PCT Pub. No.: WO80/01817

PCT Pub. Date: Sep. 4, 1980

[30] Foreign Application Priority Data

Feb. 27, 1979 [SE] Sweden ..... 7901731

[51] Int. Cl.[3] ..... E04C 1/00

[52] U.S. Cl. ..... 52/309.7; 52/694

[58] Field of Search ..... 52/602, 694, 309.7, 52/630

[56] References Cited

U.S. PATENT DOCUMENTS

| | | | |
|---|---|---|---|
| 3,305,991 | 2/1967 | Weismann | 52/309.7 X |
| 3,885,369 | 5/1975 | Ott | 52/602 X |
| 4,159,606 | 7/1979 | Kindberg | 52/694 X |

FOREIGN PATENT DOCUMENTS

| | | |
|---|---|---|
| 1609571 | 3/1970 | Fed. Rep. of Germany . |
| 2138074 | 2/1973 | Fed. Rep. of Germany . |
| 1337792 | 8/1963 | France . |
| 2373651 | 7/1978 | France . |

*Primary Examiner*—Carl D. Friedman

*Attorney, Agent, or Firm*—Burns, Doane, Swecker & Mathis

[57] ABSTRACT

A floor is disclosed comprising joists partially embedded in a slab. The joists are composed of a web and two flanges, the web having a lattice structure and the slab consisting of a cast, light material.

10 Claims, 3 Drawing Figures

FLOOR

The present invention relates to a floor comprising joists carrying between them slabs. Such floors have usually a high weight which requires strong dimensioning and renders it difficult to make channels for wiring, tubing, ventilation and heating. The invention is an improvement in this regard in that the joists have a lattice shaped web, for instance a rod bent to zigzag shape, and two flanges. Furthermore the slabs are made of a light material, for instance cellular plastic as polyurethane, and have a lower height than the joists and are placed at the lower portion of the joists so that a free space is formed at the upper part of the joists.

BRIEF DESCRIPTION OF THE DRAWINGS

The invention is closer described in the following specification with drawings wherein like members bear like reference numerals and wherein.

DETAILED DESCRIPTION OF THE PREFERRED EMBODIMENT

Figure 1:
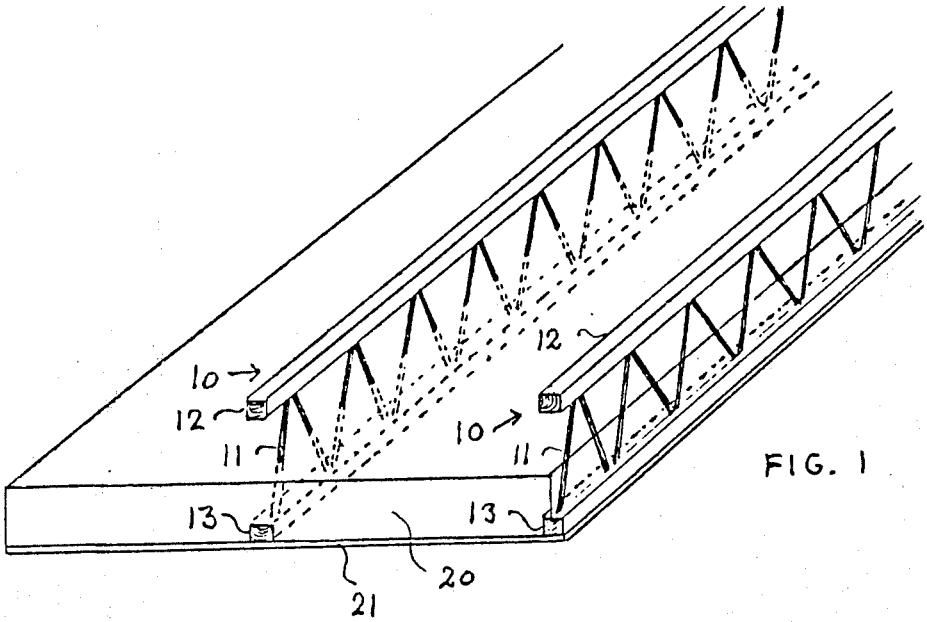
FIG. 1 is a perspective view of a floor according to the invention.
Figure 2:
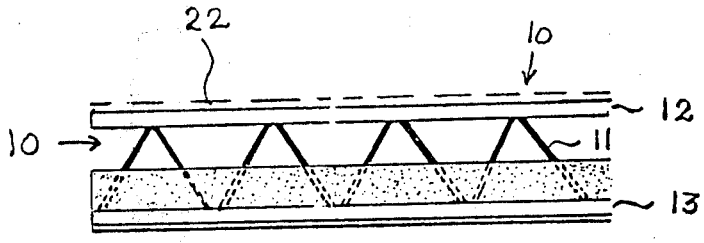
FIG. 2 is a section of the floor in FIG. 1 along the joists.
Figure 3:
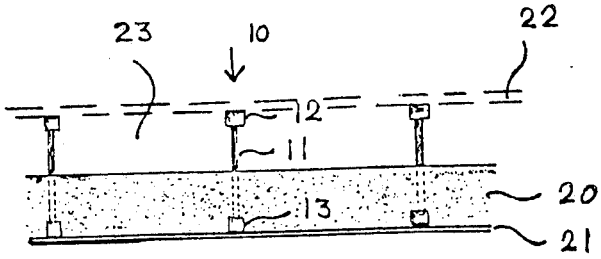
FIG. 3 is a section of the floor in FIG. 1 perpendicularly to the joists.

The joists 10 are composed of a web 11 having the form of a lattice formed by a metal rod or similar bent to zigzag shape and two wood flanges, one upper 12 and one lower flange 13. The web is fastened to the flanges, suitably by countersinking into recesses in the flanges and fastening the bent portions of the web there by glueing or some similar method. As a glue can suitably be used a hardening glue, for instance polyurethane or some other glueing plastic, or epoxy glue. The invention can, however, also be used for similar joists having a mechanical fastening of the web in the flanges by means of nails, bolts or other fastening means.

At the lower part of the joists there are attached by casting or in some other way slabs 20 which have a lower height than the joists and suitably have their lower side level with the lower side of the joists. The upper side of the slabs will in this way lie below the upper flange 12 of the joists, for instance at half the height of the joist. The slabs 20 are made of a light material, suitably cellular plastic as polyurethane, which adheres to the joists with a glueing effect, and shall be self-supporting and suitably also be strong enough to carry the assemblers during the erection stage. On the bottom side of the slabs a panel 21 can be added which also can be made adhering to the slab by the glueing effect mentioned.

The slabs 20 can suitably be cast in contact with the joists 10 for instance by prefabricating units on the ground, each unit comprising one or more joists with attached slabs 20. These units are then lifted to their place in the building and the floors can be assembled to the desired size by mounting a number of units side by side. Alternatively it is of course possible first to mount the joists 10 in their final place in the building and then cast the slabs 20 in their final place.

The described structure has a low weight. The position of the slab 20 at the lower part of the joists 10 leaves a space 23 above the slab 20 up to a floor panel 22 which is attached to the upper flange 12 of the joists. This space 23 is open not only along the joists but also transversely through the openings in the lattice structure of the webs 11. The floor can thus be used for installation of wiring and piping for water and drain in all directions along the floor. It is also possible to use the floor for circulation of air in all directions, with or without ducts, for cooling or heating or for a fresh air supply.

The use of wood flanges according to the described embodiment has the advantage that the floor boards can be nailed directly to the flanges. Alternatively metal flanges can be used, for instance of aluminium, steel or other suitable metals.

A specific advantage of the described structure, besides the already mentioned, is the low weight of the structure in combination with a great stiffness, properties which facilitate the lifting and assembly of prefabricated units.

The principles and preferred embodiments of the present invention have been described in the foregoing specifications. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. Floor component comprising joists and slabs arranged between the joists, each of the joists includes a web arranged between two flanges for supporting a load perpendicular to the flanges, the web having a lattice structure, the slabs being the sole interconnection between the joists, said slabs being self-supporting and consisting of a cast, light cellular foamed plastic material, a top surface of the slabs being lower than a top surface of the joists and extending through the lattice.

2. Floor as defined in claim 1, wherein a bottom side of the slabs is substantially level with the bottom side of the joists.

3. Floor as defined in claim 1, wherein the web is a metal rod bent to zigzag form.

4. Floor as defined in claim 3, wherein the flanges are of wood and have recesses in which the bent portions of the web are inserted.

5. Floor as defined in claim 3 or 4, wherein each of the bent portions of the web is attached to one of the flanges by glue.

6. Floor as defined in claim 5, wherein the glue is polyurethane.

7. Floor as defined in claim 1, wherein the floor is assembled from prefabricated units, each consisting of at least one joist and adjoining slabs.

8. Floor as defined in claim 1, wherein the slabs are made of a material that adheres with a glueing effect to the joists.

9. Floor as defined in claim 1, wherein the slabs adhere to the joists such that the slabs and the joists form a rigid unit.

10. Floor as defined in claim 1, wherein the cellular plastic is polyurethane.

* * * * *